United States Patent [19]

Wakamiya

[11] Patent Number: 4,648,256

[45] Date of Patent: Mar. 10, 1987

[54] SHAPE CONTROL APPARATUS FOR FLAT MATERIAL

[75] Inventor: Yoshinori Wakamiya, Mishinomiya, Japan

[73] Assignee: Mitsubishi Denki Kabushiki Kaisha, Tokyo, Japan

[21] Appl. No.: 727,143

[22] Filed: Apr. 25, 1985

[30] Foreign Application Priority Data

May 9, 1984 [JP] Japan ..... 59-94907

[51] Int. Cl.[4] ..... B21B 37/10

[52] U.S. Cl. ..... 72/8; 72/13; 72/243

[58] Field of Search ..... 72/11, 13, 8, 20, 200, 72/201, 243

[56] References Cited

U.S. PATENT DOCUMENTS

| | | | |
|---|---|---|---|
| 3,927,545 | 12/1975 | Morooka | 72/13 X |
| 3,990,284 | 11/1976 | Barten | 72/13 X |
| 4,274,273 | 6/1981 | Fariano et al. | 72/13 |
| 4,392,367 | 7/1983 | Bald | 72/13 X |

FOREIGN PATENT DOCUMENTS

| | | | |
|---|---|---|---|
| 0112110 | 8/1980 | Japan | 72/13 |
| 0156822 | 9/1982 | Japan | 72/13 |
| 58-47245 | 10/1983 | Japan . | |

*Primary Examiner*—Lowell A. Larson
*Assistant Examiner*—Steve Katz
*Attorney, Agent, or Firm*—Leydig, Voit & Mayer

[57] ABSTRACT

A shape control apparatus for producing rolled products from flat material comprising a plurality of rolls for shaping the material. Temperatures at a plurality of points, including a widthwise center of the material lying on an incoming side of the rolls, are detected to determine a widthwise temperature distribution. A rolling history of the number of products rolled and time interval between rolling of products, and the rolling weight are taken into consideration to determine a thermal crown magnitude and a roll wear magnitude for the rolls. An optimum bending force for controlling the rolls is determined based on calculated results of the thermal crown magnitude, the roll wear magnitude, and the load distribution of the rolls.

1 Claim, 8 Drawing Figures

SHAPE CONTROL APPARATUS FOR FLAT MATERIAL

BACKGROUND OF THE INVENTION

This invention relates to a shape control apparatus for flat material, and more particularly to a shape control apparatus which can form hot rolled steel into an acceptable shape.

Generally, as control apparatus of this type, there have been known apparatus wherein the temperature distribution of a hot rolled steel plate in the widthwise direction is measured to determine a widthwise load distribution which, in turn, is used to operate shape controllers such as a roll bending device and a roll coolant device to produce to produce rolled products with a desired shape from flat material.

In conventional shape control apparatus of this type, however, no consideration is given to the thermal crown, which varies with time, and the roll wear These are important factors in shape forming and, as a result, the failure to consider these factors leads to the disadvantage that defective shapes arise as time passes or as the number of rolled products increases.

SUMMARY OF THE INVENTION

This invention has the object of eliminating such disadvantages, and relates to a shape control apparatus for producing rolled products from flat material in which a thermal crown magnitude and a roll-wear magnitude in the widthwise direction of the rolls are respectively predicted from the number of rolled products, rolling time interval between a number of rolled products and rolling weight after a changer in the vertical spaceing of the rolls. A rolling load distribution is determined from a widthwise temperature distribution of the flat material determined from temperatures of the material at a plurality of points including a widthwise center of the material lying on the incoming side of the rolls. An optimum roll bending force is determined on the basis of the above results and is used for controlling a roll bending device, whereby rolled products having an acceptable shape are produced from flat material even when time passes and the number of rolled products increases.

DETAILED DESCRIPTION OF THE INVENTION

Figure 2:
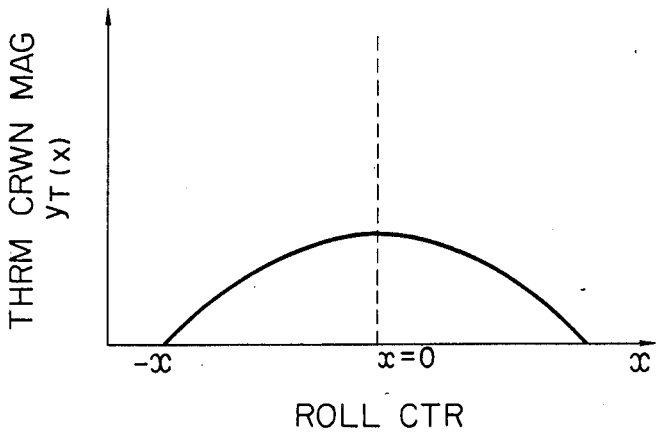
FIG. 2 is a graph showing the thermal crown magnitude of rolls in the widthwise direction of a flat material.
Figure 3:
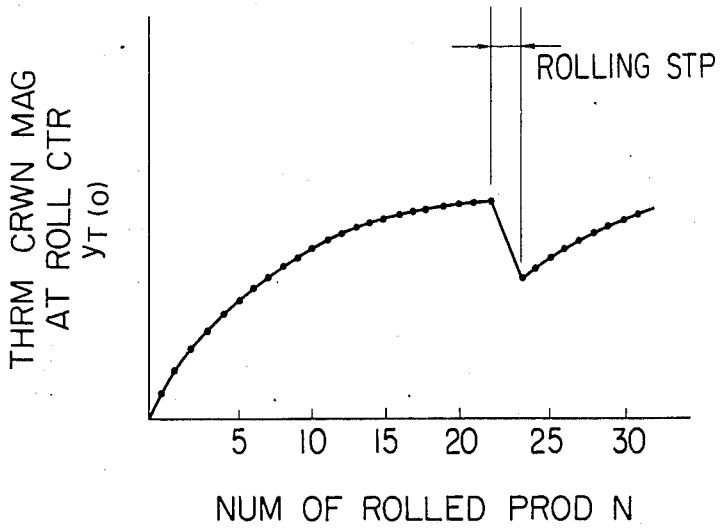
FIG. 3 is a graph showing the relationship between the thermal crown magnitude at the center of the rolls in the lengthwise direction and the number of rolled products.

The principle of this invention is as described below. An arbitrary time after the rearrangement of rolls in a hot rolling line, the thermal crown magnitude $Y_T(x)$ of the rolls is symmetric with respect to the center of the rolls in the lengthwise direction thereof and can be substantially expressed by a quadratic equation as illustrated in FIG. 2. Illustrated as a function of rolling time or the number of rolled products and, considering a rolling time interval typically occurs between the rolling of different numbers of rolled products, the thermal crown magnitude $Y_T(0)$ at the roll center is as illustrated in FIG. 3. It is seen from FIG. 3 that:

(1) The thermal crown magnitude changes rapidly after a change in the vertical spacing of the rolls.

(2) As the rolling proceeds, the change in the thermal crown magnitude becomes slower.

(3) When a rolling interval such as rolling cessation is introduced of a long duration, the thermal crown magnitude decreases because of a decrease in the temperature of the rolls, and is changed rapidly again after rolling resumes following the interval.

In view of the above, the thermal crown magnitude $Y_T(x)$ is expressed by the following equation on the basis of the number N of rolled products and the rolling time interval between the rolling of products after a change in the vertical spacing of the rolls:

$$Y_T(x)=(A_Tx^2+B_Tx+C_T)\cdot\{1-\exp(-D_T\cdot N_E)\} \quad (1)$$

$$N_E=(N_E^{N-1}+1)\cdot\exp(-E_T\cdot T) \quad (2)$$

where $Y_T(x)$ . . . the thermal crown magnitude of the rolls, x . . . the coordinate value of the rolls in the longitudinal direction thereof, $A_T$, $B_T$, $C_T$, $D_T$, $E_T$ . . . constants, $N_E$ . . . the equivalent number of rolled products, $N_E^{N-1}$ . . . the equivalent number of rolled products preceding by one product, $\tau$ . . . the period of time of a rolling interval since the rolling of the preceding product.

Figure 4:
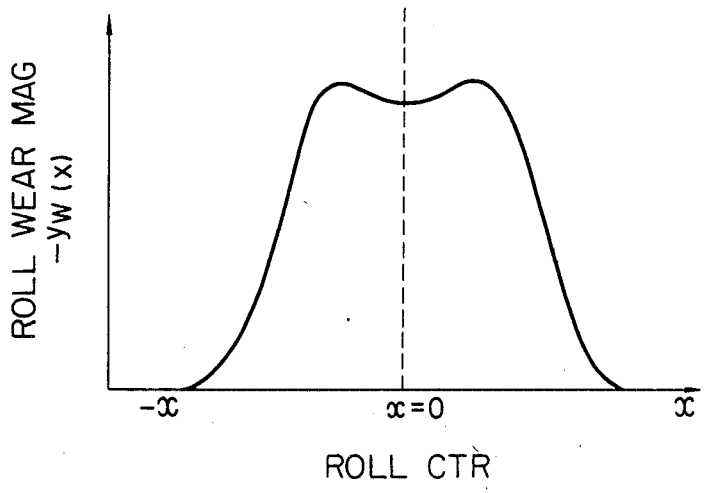
FIG. 4 is a graph showing the wear magnitude of the rolls in the widthwise direction of the flat material.

Next, a roll wear magnitude $Y_W(x)$ will be described. An arbitrary time after a change in the vertical spacing of the rolls, roll wear magnitude is also symmetric with respect to the roll center as illustrated in FIG. 4, and it can be expressed by a biquadratic equation.

Figure 5:
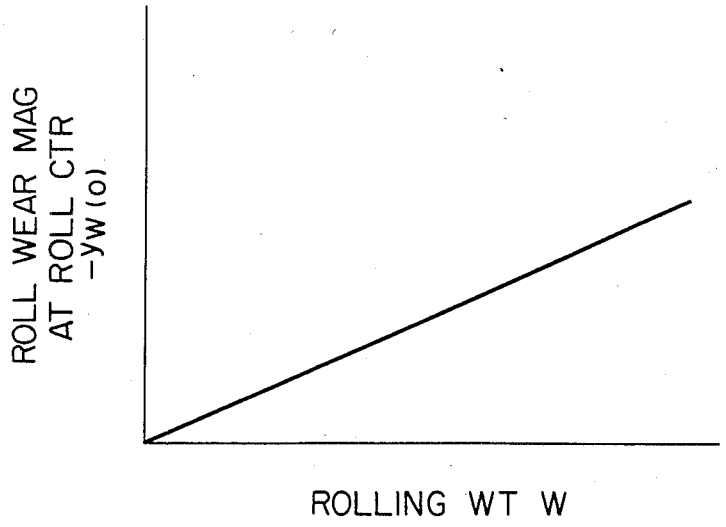
FIG. 5 is a graph showing the relationship between the roll wear magnitude at the roll center and the rolling weight.

In addition, when the wear magnitude $Y_W(0)$ at the roll center is illustrated versus rolling weight W after a change in the vertical spacing of the rolls, a substantially proportional relation exists and is illustratively shown in FIG. 5.

In view of the above, the roll wear magnitude $Y_W(x)$ can be expressed by the following equation on the basis of the rolling weight W after a change in the vertical spacing of the rolls:

$$Y_W(x)=(A_Wx^4+B_Wx^3+C_Wx^2+D_WX+E_W)*W \quad (3)$$

where $Y_W(x)$ . . . roll wear magnitude, $A_W$, $B_W$, $C_W$, $D_W$, $E_W$ . . . constants, W . . . rolling weight after the change in vertical spacing of the rolls.

Next, the curvature magnitude of rolling mill rolls will be described. Usually, a dynamic equation concerning the roll curvature is expressed by the following:

$$\frac{d^2Y_B}{dx^2} = \frac{P(x)}{E \cdot I} + \frac{1}{\alpha \cdot G \cdot A} \cdot \frac{d^2P(x)}{dx^2)} \quad (4)$$

where $Y_B$ . . . the curvature magnitude of a roll axis,

E . . . the modulus of longitudinal elasticity of the rolls,

I . . . the second moment of area of the rolls, $\alpha$ . . . constant,

G . . . the modulus of transverse elasticity of the rolls,

A . . . the cross-sectional area of the rolls,

P(x) . . . distributed rolling load in the axial direction of the rolls.

In order to solve Eq. (4), the load distribution P(x) and boundary conditions may be given.

Figure 6:
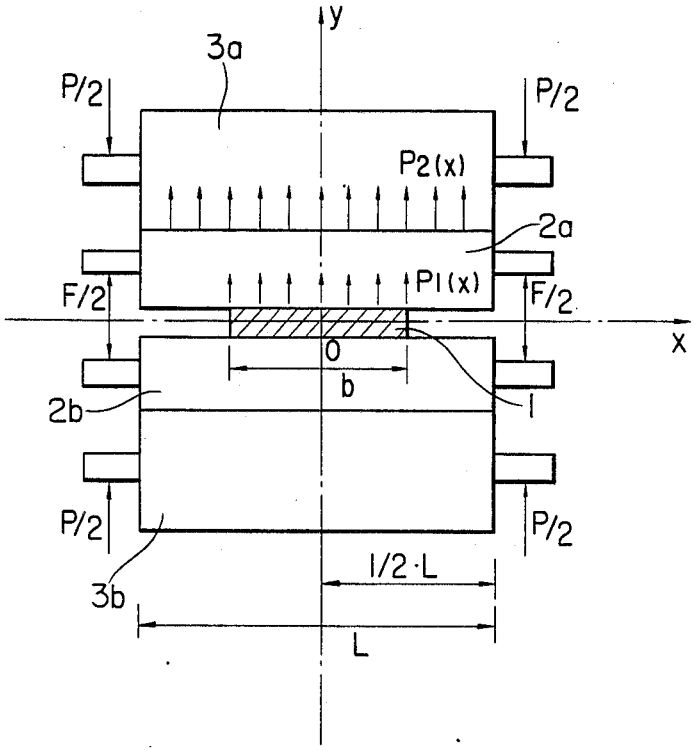
FIG. 6 is an explanatory diagram showing the load distribution of a rolling mill in the state in which rolls curve.

FIG. 6 shows a rolling load distribution in a quadruple rolling mill in the state in which rolls curve. In FIG. 6, the x-axis represents coordinates in the direction of a roll axis (in the widthwise direction of a flat material), while the y-axis represents coordinates indicative of the curvature of the roll axis.

A flat material 1 is rolled by upper and lower work rolls 2*a* and 2*b*. Under this condition, a load distribution $P_1(x)$ arises between the flat material 1 and the upper work roll 2*a*. Simultaneously, a load distribution $P_2(x)$ arises between the upper work roll 2*a* and an upper backup roll 3*a*. Letter P in the figure indicates a rolling load which is detected by a load detector which produces rolling force representing signals processed in the apparatus, and letter F indicates a bending force which acts between the upper and lower work rolls 2*a* and 2*b*. Thus, the difference between the rolling load P and bending force F is the rolling weight W.

When the balance of the forces is considered in FIG. 6, $$P - F = \int_{-\frac{1}{2}b}^{\frac{1}{2}b} P_1(x)dx = W \quad (5)$$

where b . . . the width of the flat material. $P_1(x)$ can be evaluated by knowing the widthwise temperature distribution of the flat material 1:

$$P_1(x) = K\sqrt{R' \cdot \Delta h \cdot Q_p} \quad (6)$$

$$K = K_o \cdot \epsilon^n \cdot \dot{\epsilon}^m \cdot \exp\frac{\alpha}{T(x)} \quad (7)$$

where

R' . . . deviating roll radius, $\Delta h$ . . . rolling reduction, $Q_P$ . . . reduction force function, K . . . deformation resistance, $K_o$, n, m, $\alpha$ . . . constants, $\epsilon$ . . . strain, $\epsilon^o$ . . . strain velocity, T . . . temperature.

In addition, when the load distribution between the upper work roll 2*a* and the upper backup roll 3*a* is indicated and the balance of the forces is considered:

$$P = \int_{-\frac{1}{2}L}^{\frac{1}{2}L} P_2(x)dx \quad (8)$$

holds where

L . . . the length of the rolls.

Figure 7:
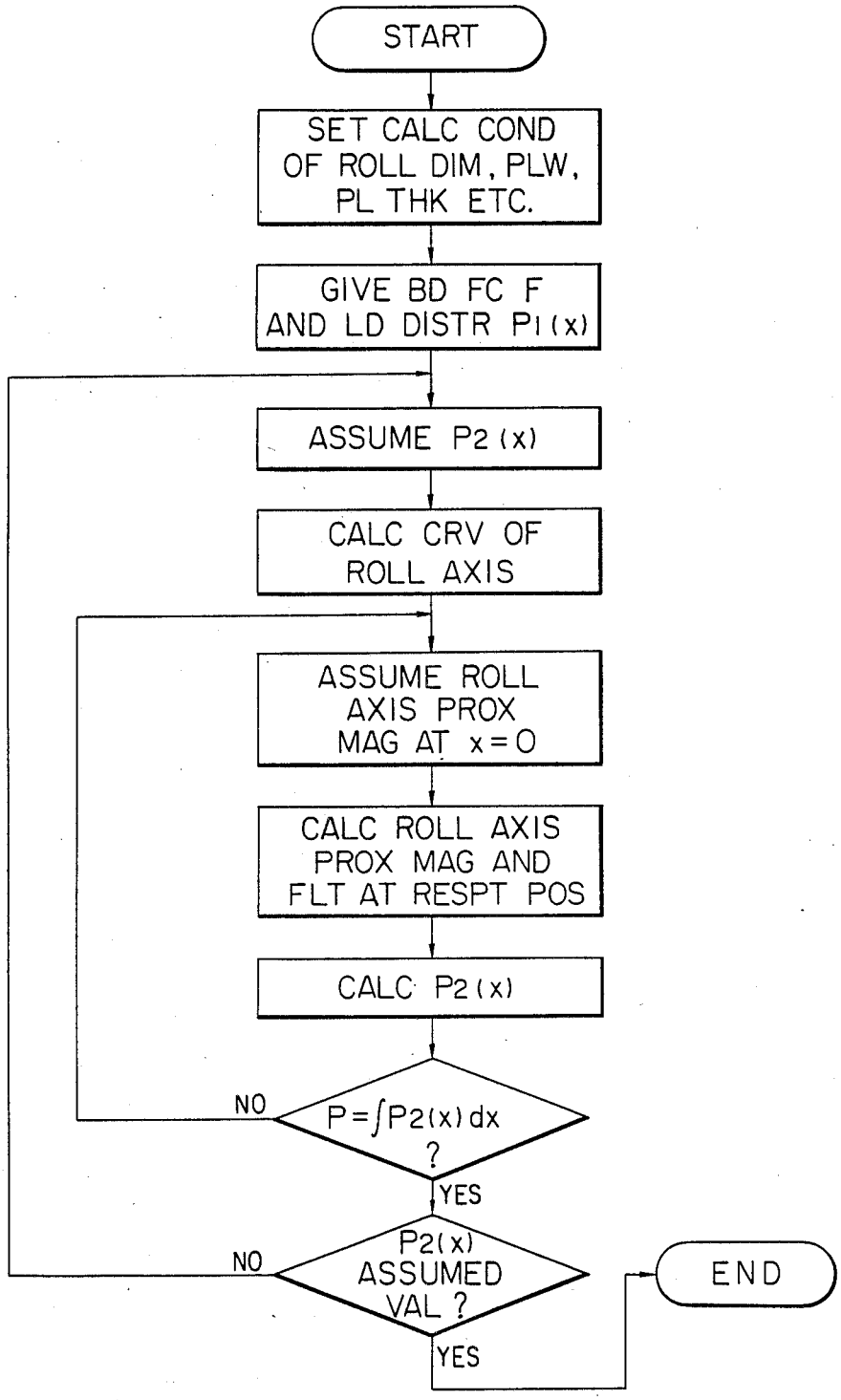
FIG. 7 is a flow chart for computing the curvature magnitude of the rolls.

In general, Eq. (4) can be solved by computing apparatus utilizing processing steps of a flow chart shown in FIG. 7.

As stated before, when the rolling load distribution $P_1(x)$ is obtained, the roll curvature $Y_B$ can be computed. It is therefore necessary to know the temperature distribution of the flat material in the widthwise direction thereof.

The widthwise temperature distribution of the flat material or steel plate in the hot rolling line can be expressed by the following quadratic equation in the light of the fundamental equation of thermal conduction:

$$T(X) = T_o - a \cdot x^2 \quad (9)$$

where $T_o$ . . . plate temperature at the center in the widthwise direction of the plate, x . . . distance (coordinate) from the center of the width of the plate, a . . . constant.

This can be computed by measuring the temperatures of at least two points including the center of the width of the plate and producing temperature representing signals which are processed in the apparatus.

In principle according to the present invention, an optimum roll bending magnitude for producing an acceptable shape of the steel plate favorable is determined for control of a roll bending device on the basis of a computed thermal crown value $Y_T(x)$ in the widthwise direction of the rolls and a computed roll wear value $Y_W(x)$ in the widthwise direction, which are based on the rolling history consisting of the number of products rolled and time intervals between rolling of products after a change in the vertical spacing weight of the rolls, and the roll curvature magnitude $Y_B(x)$ which is based on the rolling load determined from the temperature distribution computed from detected temperatures.

In judging the acceptable shape of the plate, the total value Y(x) is determined from the computed values of thermal crown $Y_T(x)$, the computed roll wear value $Y_W(x)$ and the roll curvature magnitude value $Y_B(x)$;

$$Y(x) = Y_T(x) - Y_W(x) + Y_B(x) \quad (10)$$

A criterion that the square deviation of the total value from Y=0 is minimized determines the optimum bending force $F_{OPT}$:

$$J = \min \int_{-\frac{1}{2}L}^{\frac{1}{2}L} \{Y(O) - Y(x)\}^2 dx \quad (11)$$

Figure 8:
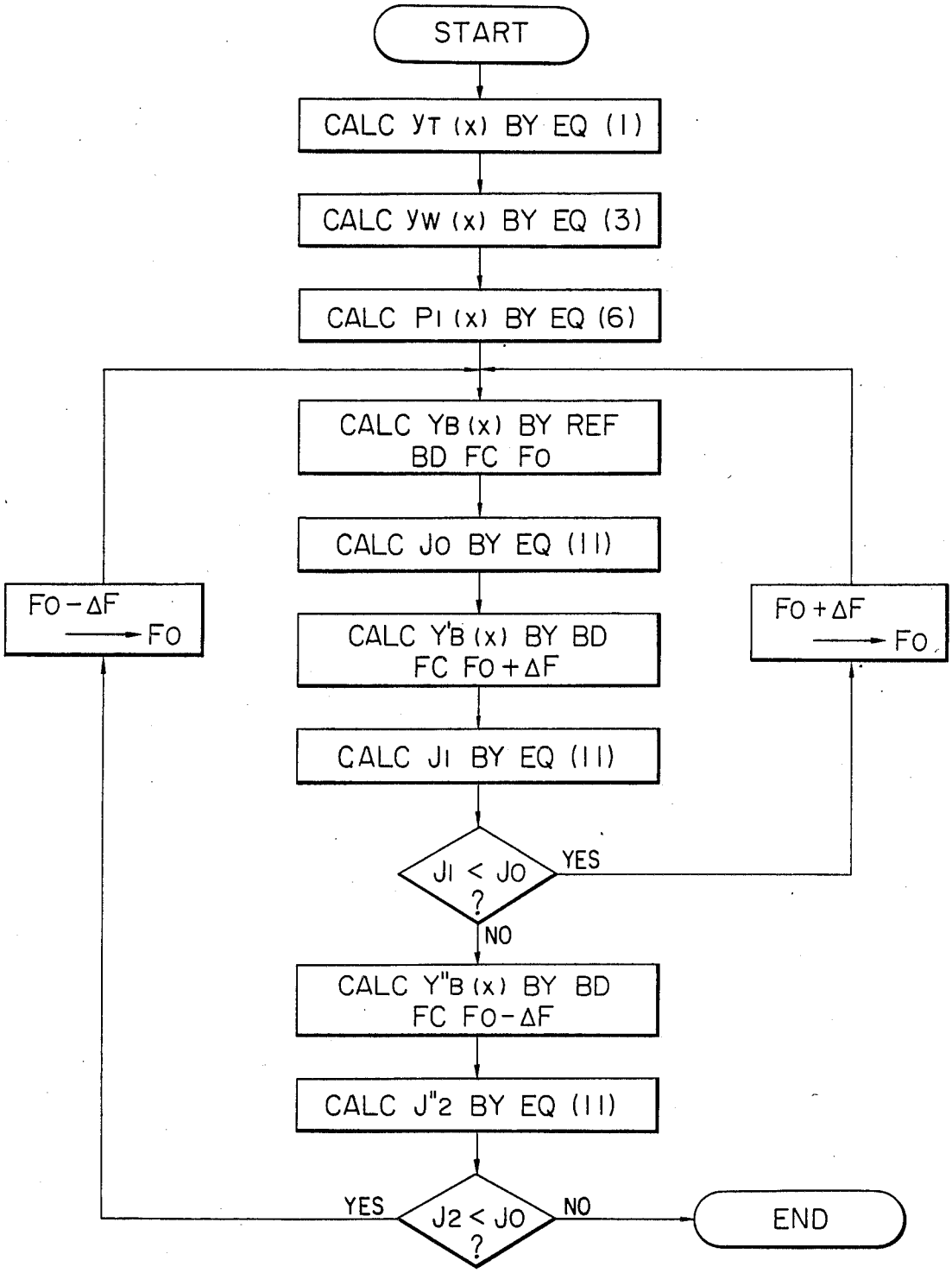
FIG. 8 is a flow chart for computing an optimum bending force.

The optimum bending force $F_{OPT}$ can be computed in accordance with a flow chart shown in FIG. 8.

Figure 1:
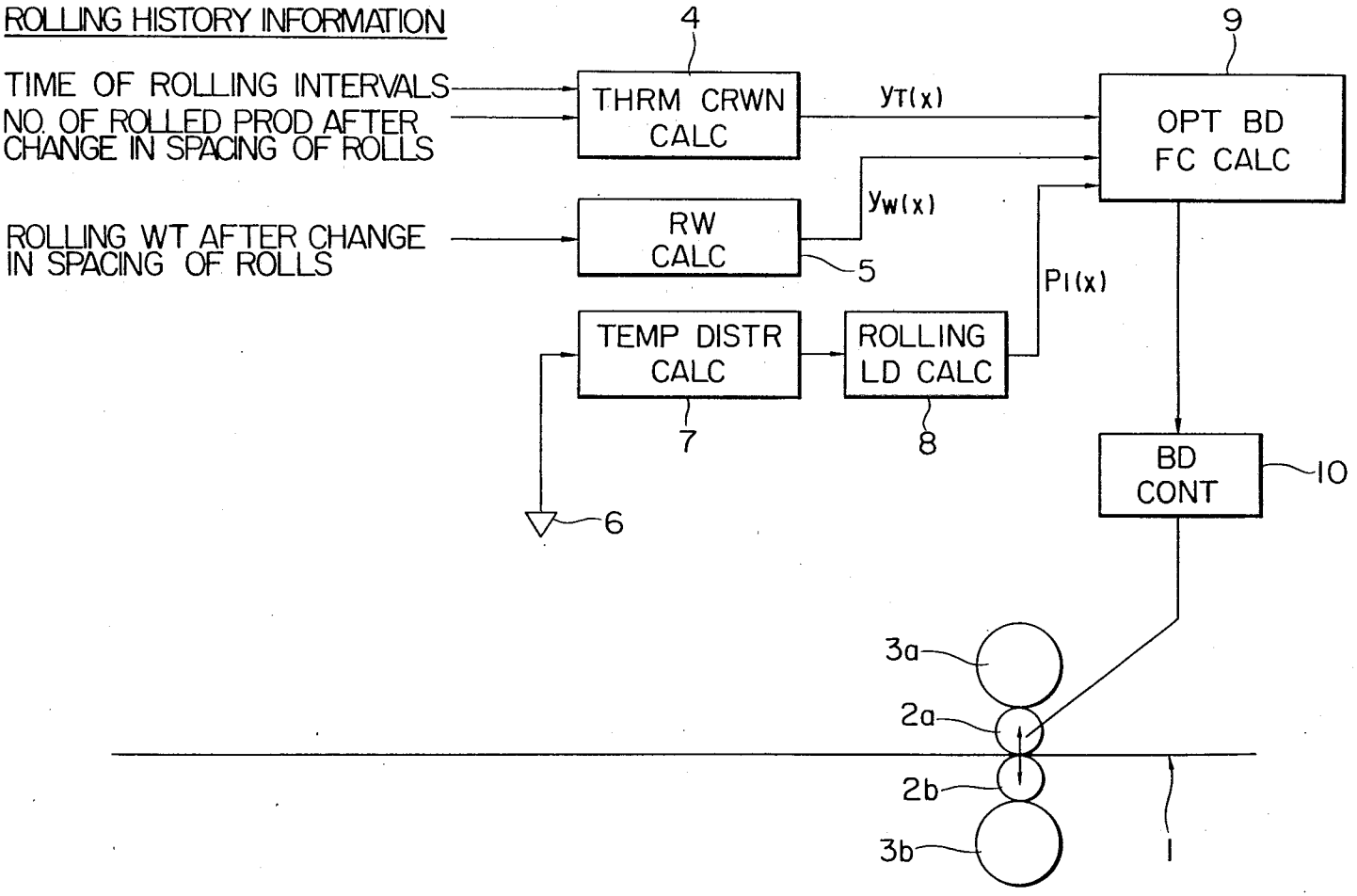
FIG. 1 is a block diagram of a shape control apparatus embodying this invention.

Now, one embodiment of this invention will be described with reference to FIG. 1.

Referring to the figure, numeral 1 designates a flat material or steel plate, symbols 2*a* and 2*b* upper and lower work rolls, and symbols 3*a* and 3*b* upper and lower backup rolls. A thermal crown magnitude calculating means, herein shown as a calculator 4, receives hysteresis data signals on the period of time of the rolling interval between rolled products and the number of rolled products counted after the change in spacing of rolls to determine the thermal crown magnitude $Y_T(x)$ in accordance with Eq. (1). A roll wear calculating means, herein shown as a roll wear calculator (5), receives data on the rolling weight after rearrangement of the rolls to determine the wear magnitude $Y_W(x)$ in accordance with Eq. (3). Both quantities $Y_T(x)$ and $Y_W(x)$ are determined only once before the steel plate 1 is bitten into the rolling mill between the rolls. Shown at numeral 6 is a thermometer for measuring the temperatures of the steel plate at at least two points including the widthwise center of the part of the steel plate 1 located on the incoming side of the rolling mill and produces temperature-representing signals. A temperature distribution determining means, herein shown as a calculator 7, determines the widthwise temperature distribution from the temperature outputs provided by the thermometer 6 in accordance with Eq. (9). A rolling load distribution determining means, herein shown as a rolling load distribution calculator 8, is connected to the temperature distribution determining means to determine the widthwise rolling load distribution on the rolls from the widthwise temperature distribution in accordance with Eq. (6).

An optimum bending force determining means, herein shown in part as a calculator 9, receives the output values $Y_T(x)$, $Y_W(x)$ and $P_1(x)$ of the respective calculators 4, 5 and 8 as input values to determine the optimum bending force $F_{OPT}$ to be applied to the rolls in accordance with the flow chart of FIG. 8.

The optimum bending force determining means further includes a controlling means, herein shown as a bending controller 10, receiving the output value of the optimum bending force $F_{OPT}$ to control bending in consideration of the time at which the point of the steel plate 1 measured by the thermometer 6 reaches the rolling mill.

Thus, this embodiment takes into account, not only the roll curvature based on the temperatures distributed in the widthwise direction of the plate, but also the thermal crown magnitude of the rolls and the roll wear magnitude based on the rolling history information after a change in spacing of the rolls, so that an acceptable shape control is possible even when the number of rolled products increases or when rolling is stopped.

As set forth above, according to this invention, a thermal crown magnitude and a roll wear magnitude in the widthwise direction of rolls as based on rolling history information i.e., number of products rolled and time intervals of rolling, after a change in vertical spacing of the work rolls are respectively determined, while a rolling load distribution is determined from the widthwise temperature distribution of a flat material determined from temperatures of the material at a plurality of points lying on the incoming side of a rolling mill. An optimum roll bending force is determined on the basis of the results as calculated above and is used for bending control, so that a flat material having an acceptable shape can always be produced even when the number of rolled products increases or when rolling is stopped.

What is claimed is:

1. A shape control apparatus for producing rolled products from flat material and having rolls for shaping said material, said shape control apparatus comprising:

a thermal crown calculating means having an input receiving product number signals representing count of rolled products from flat material rolled in said rolls and time interval signals representing rolling time intervals following rolling of a number of products and operable for determining from said product number and interval-representing signals an output representing thermal crown magnitude in a widthwise direction of said rolls after a change in a space between the rolls following rolling of a number of rolled products, a roll wear calculating means having an input receiving rolling weight signals representing rolling weight of said rolls and operable for determining from said rolling weight-representing signals an output representing roll wear magnitude in a widthwise direction of said rolls, means for measuring temperatures of said material at a plurality of points in a widthwise direction at a leading portion of flat material entering said rolls and producing temperature-representing signals, means for calculating widthwise rolling load distribution on said rollers including:

a temperature distribution calculating means having an input receiving said temperature-representing signals and operable for determining from said temperature-representing signals an output representing a temperature distribution of the material in a widthwise direction of said rolls at the leading portion of the material entering said rolls, said points including a widthwise center of said material, a rolling load distribution calculating means having an input receiving said output representing widthwise temperature distribution from said last named means and operable for determining therefrom an output representing a widthwise rolling load distribution on said rolls, an optimum bending force calculating means having an input receiving said outputs representing thermal crown magnitude, roll wear magnitude, and widthwise rolling load distribution and operable for determining therefrom an output representing an optimum bending force to be applied to said rolls, and means for controlling bending of said rolls receiving said optimum bending force output from said optimum bending force calculating means to control bending of said rolls as the flat material enters the rolls.

* * * * *